US009579667B2

(12) United States Patent
Evans et al.

(10) Patent No.: US 9,579,667 B2
(45) Date of Patent: Feb. 28, 2017

(54) ADJUSTABLE BODY SPRAY

(75) Inventors: Kenneth E. Evans, Westlake, OH (US); Terrence A. Pagano, Broadview Heights, OH (US); Eric M. Weber, Medina, OH (US)

(73) Assignee: Moen Incorporated, North Olmsted, OH (US)

( * ) Notice: Subject to any disclaimer, the term of this patent is extended or adjusted under 35 U.S.C. 154(b) by 640 days.

(21) Appl. No.: 13/437,508

(22) Filed: Apr. 2, 2012

(65) Prior Publication Data

US 2012/0248222 A1 Oct. 4, 2012

Related U.S. Application Data

(60) Provisional application No. 61/471,108, filed on Apr. 2, 2011.

(51) Int. Cl.
*B05B 15/06* (2006.01)
*B05B 1/18* (2006.01)

(52) U.S. Cl.
CPC ..... *B05B 1/185* (2013.01); *B05B 15/067* (2013.01)

(58) Field of Classification Search
CPC B05B 1/12; B05B 15/066; B05B 1/32; B05B 15/067; B05B 1/185; F16L 27/04
USPC ..... 239/587.5, 587.6, 455, 456; 285/261, 285/146.1, 272, 8
See application file for complete search history.

(56) References Cited

U.S. PATENT DOCUMENTS

| | | | | |
|---|---|---|---|---|
| 833,613 | A | 10/1906 | Maiser | |
| 1,500,921 | A * | 7/1924 | Bramson | F16L 11/18 138/120 |
| 3,486,726 | A | 12/1969 | Kindorf et al. | |
| 3,547,385 | A | 12/1970 | Kindorf et al. | |
| 4,119,285 | A | 10/1978 | Bisping et al. | |
| 5,060,892 | A | 10/1991 | Dougherty | |
| 5,149,146 | A * | 9/1992 | Simoni | B05B 15/067 285/146.1 |
| 5,275,199 | A | 1/1994 | Howell | |
| 6,109,765 | A | 8/2000 | Blanton | |
| 6,350,373 | B1 | 2/2002 | Sondrup | |
| 6,402,096 | B1 | 6/2002 | Ismert et al. | |
| 6,536,809 | B2 | 3/2003 | Marty et al. | |
| 6,708,937 | B2 | 3/2004 | Thurman | |
| 6,807,983 | B1 * | 10/2004 | Erickson | E03C 1/042 137/15.01 |
| 7,137,414 | B2 * | 11/2006 | Andres | F16L 11/22 138/109 |
| 7,246,760 | B2 | 7/2007 | Marty et al. | |
| 7,455,247 | B2 * | 11/2008 | Kajuch | B05B 1/18 239/227 |
| 7,509,971 | B2 | 3/2009 | Kajuch | |
| 7,628,341 | B2 | 12/2009 | Kajuch | |
| 7,770,825 | B2 | 8/2010 | Kajuch | |
| 7,793,365 | B2 | 9/2010 | Miura et al. | |
| 8,176,934 | B2 | 5/2012 | Niver | |
| 8,360,346 | B2 | 1/2013 | Furseth | |

(Continued)

*Primary Examiner* — Arthur O Hall
*Assistant Examiner* — Joel Zhou
(74) *Attorney, Agent, or Firm* — Calfee, Halter & Griswold LLP

(57) ABSTRACT

The present invention provides an adjustable body spray including an adjustable spray assembly and an adjustable mounting assembly that, alone or in combination, ensure proper alignment of components of the body spray and adequate sealing between the components.

17 Claims, 9 Drawing Sheets

(56) References Cited

U.S. PATENT DOCUMENTS

| | | | | |
|---|---|---|---|---|
| 2005/0098697 | A1 | 5/2005 | Collins | |
| 2009/0114739 | A1* | 5/2009 | Furseth | E03C 1/0408<br>239/243 |
| 2010/0000614 | A1 | 1/2010 | Zahuranec et al. | |
| 2010/0132810 | A1* | 6/2010 | Pompian | E03C 1/021<br>137/356 |
| 2010/0171304 | A1* | 7/2010 | Davis | 285/189 |

* cited by examiner

ADJUSTABLE BODY SPRAY

CROSS-REFERENCE TO RELATED APPLICATION

This application claims the benefit of U.S. Provisional Application No. 61/471,108, filed Apr. 2, 2011, the entire disclosure of which is hereby incorporated by reference.

FIELD

The present invention relates generally to an adjustable body spray, and, more particularly, to an adjustable body spray including an adjustable spray assembly and an adjustable mounting assembly that, alone or in combination, ensure proper alignment of components of the body spray and adequate sealing between the components.

BACKGROUND

When installing a traditional body spray, all of the components need to be properly aligned in order for a spray face to be mounted flush with an escutcheon and the spray face to be centered in an opening in the escutcheon. If misalignments are introduced during installation, the spray face will not be mounted flush with the escutcheon and/or the spray face will not be centered in the opening in the escutcheon.

SUMMARY

The present invention provides a body spray for mounting in an opening in a mounting surface. In an exemplary embodiment, the body spray includes a mounting assembly and a spray assembly. The mounting assembly includes a connector. The connector is operable to connect to a water supply pipe. The connector includes a port. The spray assembly includes a spray head and a shower pivot assembly. The spray head is operable to deliver water from the body spray. The shower pivot assembly includes a pivot and a shaft. The pivot is operable to be attached to the spray head. At least a portion of the shaft is operable to be inserted into the port of the connector. The shower pivot assembly is operable to angularly move relative to the port of the connector. The angular movement of the shower pivot assembly relative to the port of the connector enables the spray head to be adjusted relative to the opening in the mounting surface.

The present invention provides a spray assembly for use in a body spray. In an exemplary embodiment, the spray assembly includes a spray head and a shower pivot assembly. The spray head is operable to deliver water from the body spray. The shower pivot assembly includes a pivot and a shaft. The pivot is operable to be attached to the spray head. At least a portion of the shaft is operable to be inserted into the port of the connector. The shower pivot assembly is operable to angularly move relative to the port of the connector. The angular movement of the shower pivot assembly relative to the port of the connector enables the spray head to be adjusted relative to the opening in the mounting surface.

The present invention provides a body spray for mounting in an opening in a mounting surface. In an exemplary embodiment, the body spray includes a mounting assembly and a spray assembly. The mounting assembly includes a connector and a bracket. The connector is operable to connect to a water supply pipe. The connector includes a port and a flange. The bracket includes a channel. The flange on the connector is operable to move in the channel on the bracket. The spray assembly includes a spray head and a shower pivot assembly. The spray head is operable to deliver water from the body spray. The shower pivot assembly includes a pivot and a shaft. The pivot is operable to be attached to the spray head. At least a portion of the shaft is operable to be inserted into the port of the connector. The shower pivot assembly is operable to angularly move relative to the port of the connector. Movement of the flange in the channel enables the shower pivot assembly to be moved so that the spray head can be adjusted relative to the opening in the mounting surface. The angular movement of the shower pivot assembly relative to the port of the connector enables the spray head to be adjusted relative to the opening in the mounting surface.

DETAILED DESCRIPTION

Figure 1:
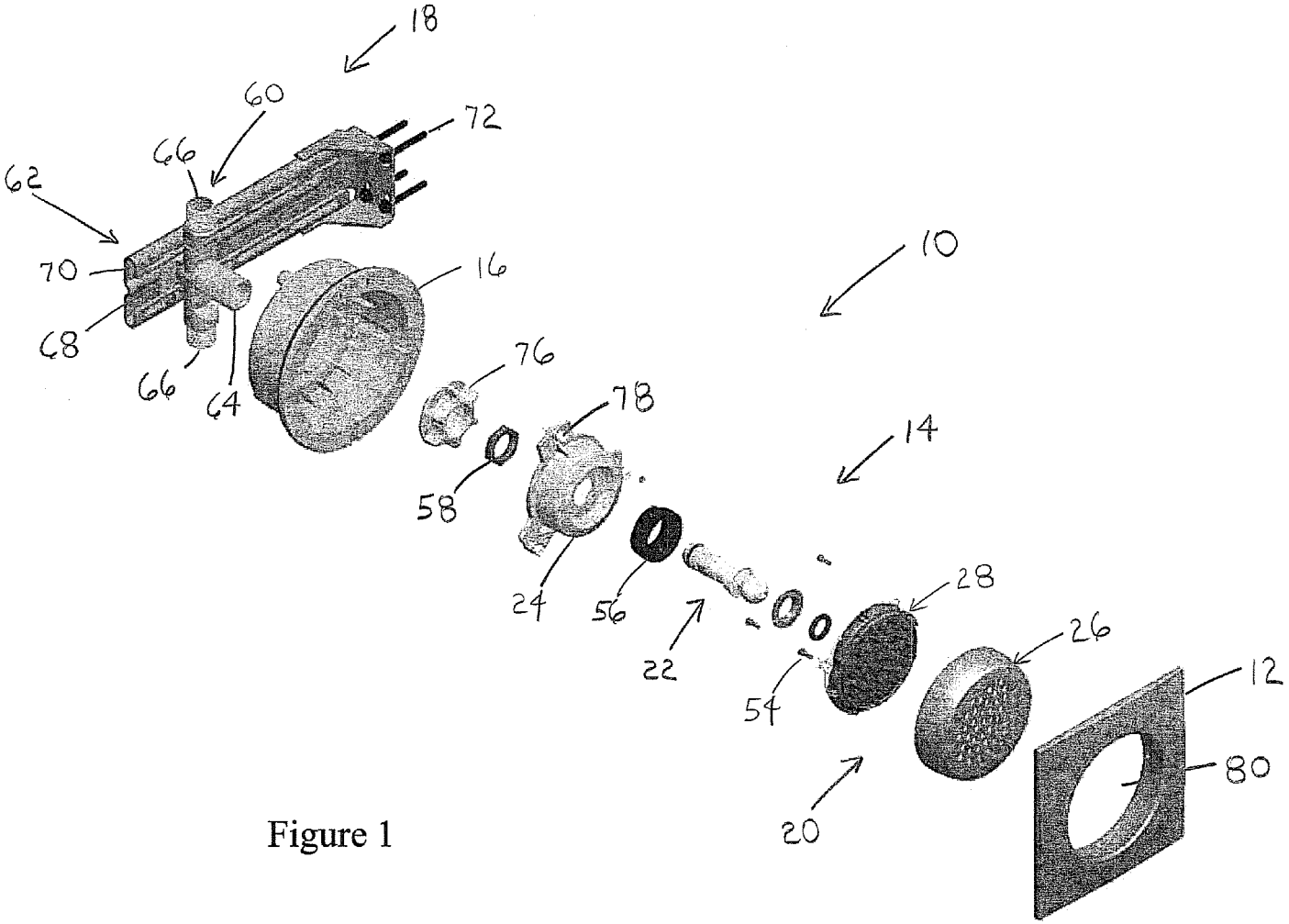
FIG. 1 is an exploded perspective view of an adjustable body spray according to an exemplary embodiment of the present invention.

The present invention provides an adjustable body spray. Exemplary embodiments of an adjustable body spray 10 of the present invention are shown in FIGS. 1-6*f*. In the illustrated embodiments, the body spray 10 includes an escutcheon 12, a spray assembly 14, a housing 16, and a mounting assembly 18.

Figure 2:
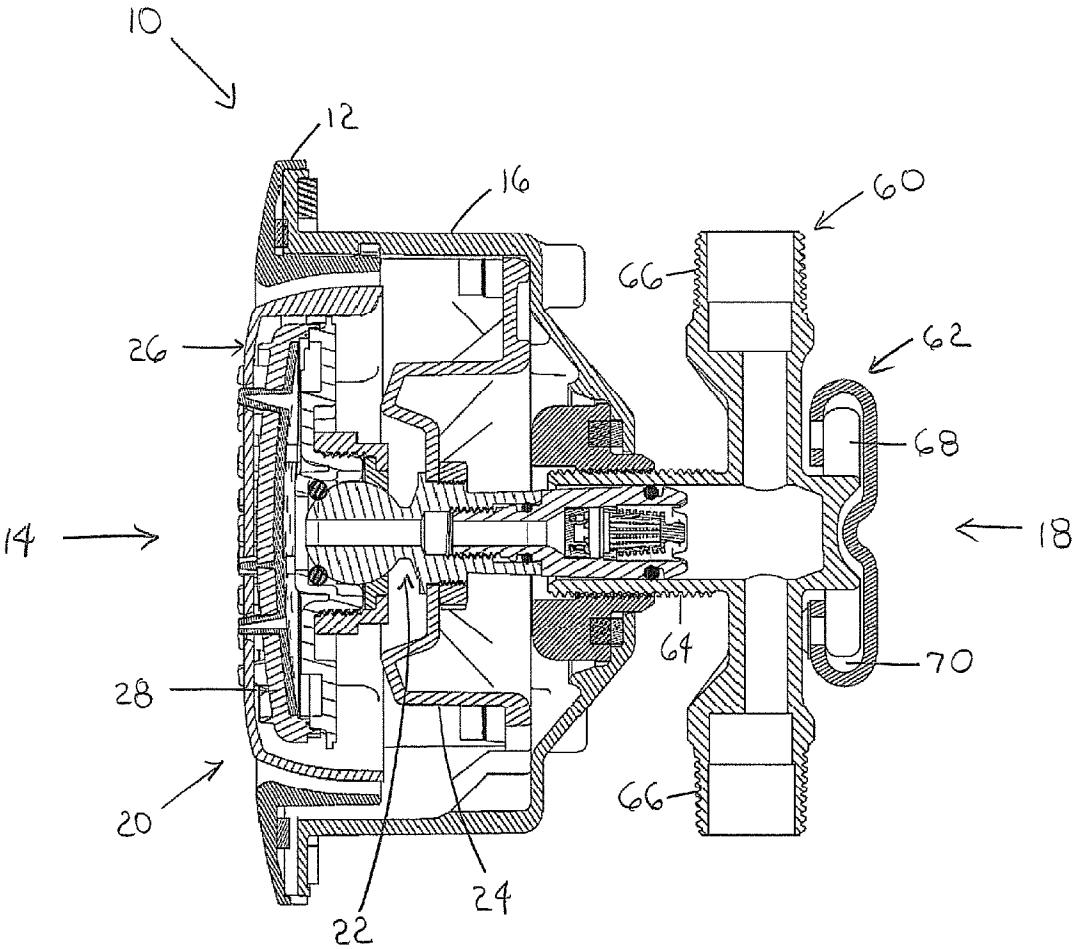
FIG. 2 is a cross-sectional view of the adjustable body spray of FIG. 1 with a horizontal port of a connector in a generally horizontal position.
Figure 3:
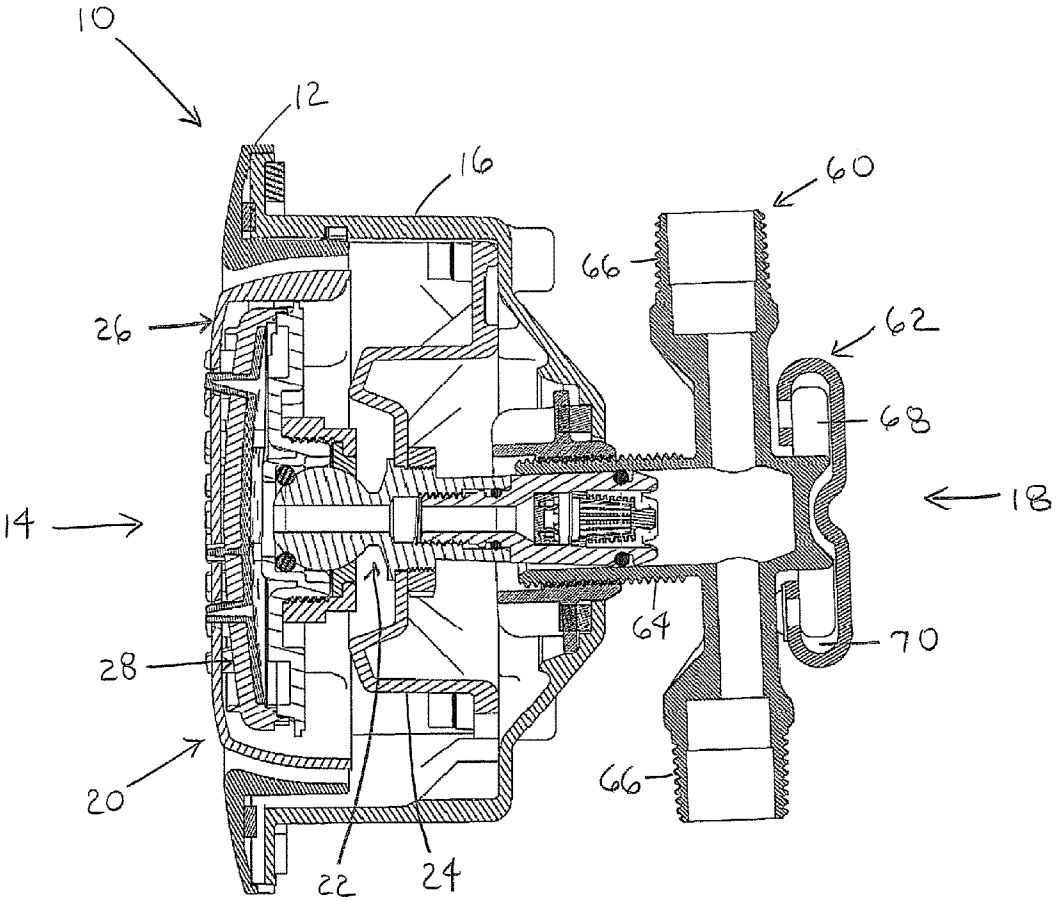
FIG. 3 is a cross-sectional view of the adjustable body spray of FIG. 1 with the horizontal port of the connector in a non-horizontal position.

An exemplary embodiment of the spray assembly 14 is shown in detail in FIGS. 1-3. In the illustrated embodiment, the spray assembly 14 includes a spray head 20, a shower pivot assembly 22, and a body 24. The spray head 20 includes a spray face 26 and a spray engine 28. Spray faces and spray engines are well-known in the art and, therefore, will not be described in greater detail.

Figure 4A:
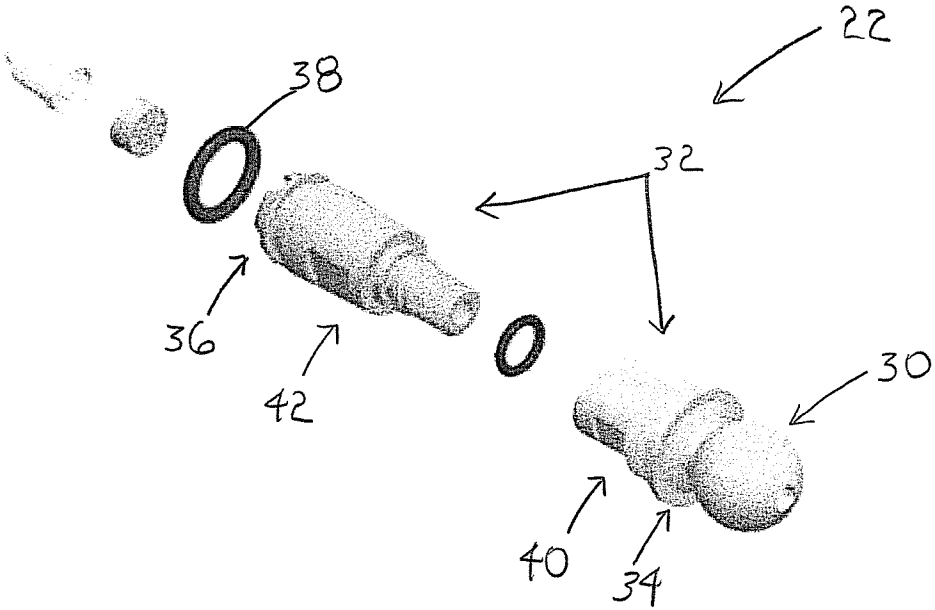
FIGS. 4*a*-4*b* are exploded perspective and cross-sectional views, respectively, of an exemplary embodiment of a shower pivot assembly for use in the adjustable body spray of FIG. 1.
Figure 4B:
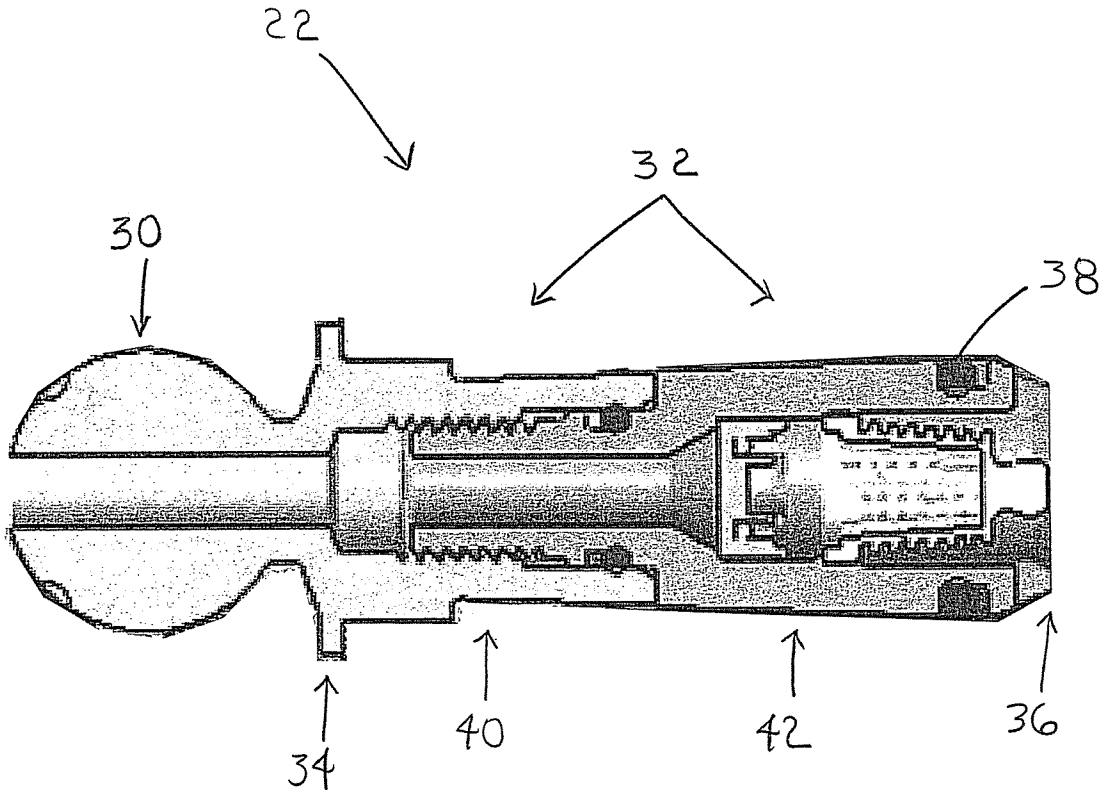

An exemplary embodiment of the shower pivot assembly 22 is shown in detail in FIGS. 4*a*-4*b*. In the illustrated embodiment, the shower pivot assembly 22 includes a pivot 30 and a shaft 32. As illustrated, the pivot 30 includes a ball. However, one of ordinary skill in the art will appreciate that the pivot 30 could include other structure that enables a pivoting movement. The shaft 32 includes a front end 34 (adjacent the ball 30) and a rear end 36 (away from the ball 30). A portion of the shaft 32 tapers outwardly between the front end 34 and the rear end 36. In an exemplary embodiment, the taper is up to 5°. In a further exemplary embodiment, the taper is 2°±¼°. As the taper of the shaft 32 increases, the size of an O-ring 38 on the shaft 32 should also increase. In the illustrated embodiment, the shaft 32 includes a forward shaft portion 40 and a rearward shaft portion 42.

However, one of ordinary skill in the art will appreciate that the shaft 32 could be integrally formed or could include more than two portions.

Figure 5:
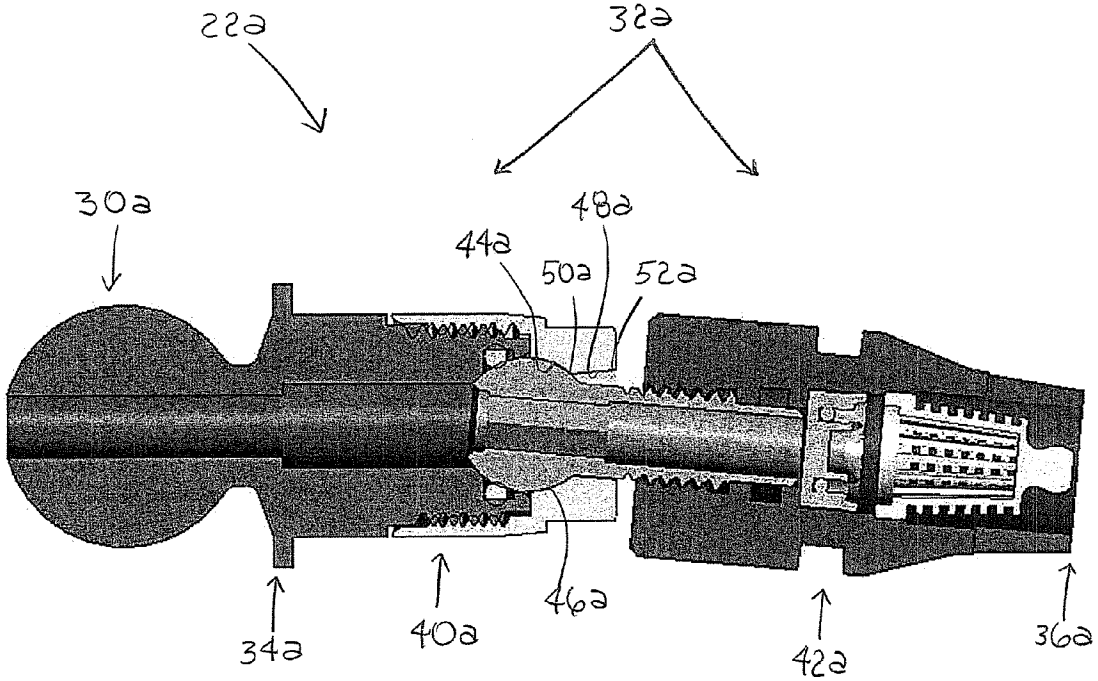
FIG. 5 is a cross-sectional view of another exemplary embodiment of a shower pivot assembly for use in the adjustable body spray of FIG. 1.

Another exemplary embodiment of the shower pivot assembly 22*a* is shown in detail in FIG. 5. In the illustrated embodiment, the shower pivot assembly 22*a* includes a pivot 30*a* and a shaft 32*a*. Again, as illustrated, the pivot 30*a* includes a ball. However, one of ordinary skill in the art will appreciate that the pivot 30*a* could include other structure that enables a pivoting movement. The shaft 32*a* includes a front end 34*a* (adjacent the ball 30*a*) and a rear end 36*a* (away from the ball 30*a*). In the illustrated embodiment, the shaft 32*a* includes a forward shaft portion 40*a* and a rearward shaft portion 42*a*. The forward shaft portion 40*a* includes a socket 44*a*. The rearward shaft portion 42*a* includes a ball 46*a*. The socket 44*a* of the forward shaft portion 40*a* receives the ball 46*a* of the rearward shaft portion 42*a*. Additionally, the socket 44*a* includes an opening 48*a*. The opening 48*a* includes a front end 50*a* and a rear end 52*a*. The opening 48*a* tapers outwardly from the front end 50*a* toward the rear end 52*a*. In the illustrated embodiment, the forward shaft portion 40*a* and the rearward shaft portion 42*a* each include two components. However, one of ordinary skill in the art will appreciate that the forward shaft portion 40*a* and/or the rearward shaft portion 42*a* could be integrally formed or could include more than two components.

During assembly, the spray engine 28 is attached to the spray face 26 using screws 54 or other conventional fasteners. The ball 30/30*a* is inserted into the spray engine 28 and is attached to the spray engine 28 using a nut 56 or other conventional fastener. The body 24 is inserted over the shaft 32/32*a* and is attached to the shaft 32/32*a* using a nut 58 or other conventional fastener.

An exemplary embodiment of the mounting assembly 18 is shown in detail in FIGS. 1-3. In the illustrated embodiment, the mounting assembly 18 includes a connector 60 and a bracket 62. The connector 60 includes a generally horizontal port 64 for receiving a portion of the shaft 32/32*a* of the shower pivot assembly 22/22*a*. The connector 60 also includes one or more generally vertical ports 66 for connection to a water supply and, if desired, to other body sprays in a shower. The connector 60 further includes a flange 68. The bracket 62 includes a channel 70. The connector 60 is attached to the bracket 62 using the flange 68. The flange 68 on the connector 60 moves in the channel 70 on the bracket 62. Although the mounting assembly 18 has been illustrated as having the flange 68 on the connector 60 that moves in the channel 70 on the bracket 62, one of ordinary skill in the art will appreciate that the mounting assembly could include other structure that enables the connector 60 to move relative to the bracket 62.

Figure 6A:
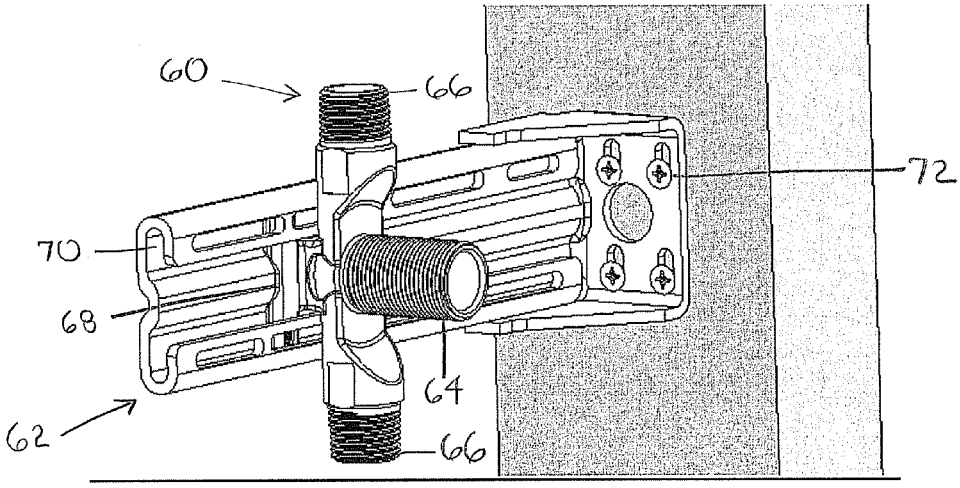
FIGS. 6*a*-6*f* are perspective views showing the installation of components of the adjustable body spray of FIG. 1.
Figure 6B:
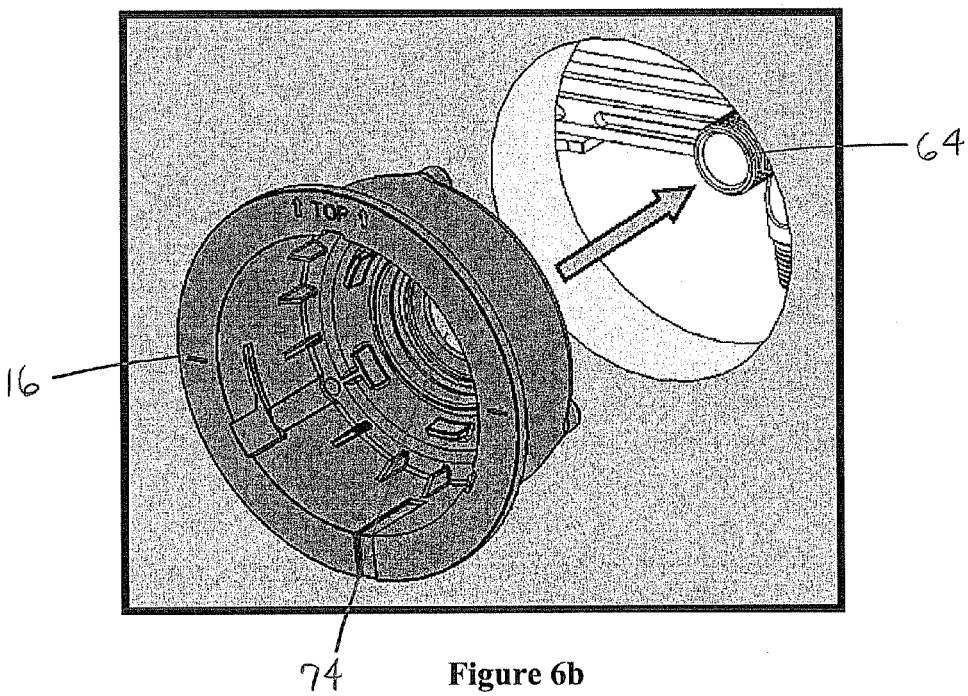

During installation, the bracket 62 is attached to a vertical support behind a mounting surface, such as a stud in a wall, using screws 72 or other conventional fasteners (see FIG. 6*a*). In the illustrated embodiment, the bracket 62 is installed in a generally horizontal orientation. Therefore, the connector 60 moves along a generally horizontal direction in the bracket 62. Alternatively, the bracket 62 could be attached to a horizontal support behind a mounting surface. In that embodiment, the bracket 62 would be installed in a generally vertical orientation. Then, the connector 60 would move along a generally vertical direction in the bracket 62.

An exemplary embodiment of the housing 16 is shown in detail in FIGS. 1-3. In the illustrated embodiment, the housing 16 includes an opening 74 (see FIG. 6*b*). The housing 16 is mounted in an opening in a mounting surface, such as a wall.

Figure 6C:
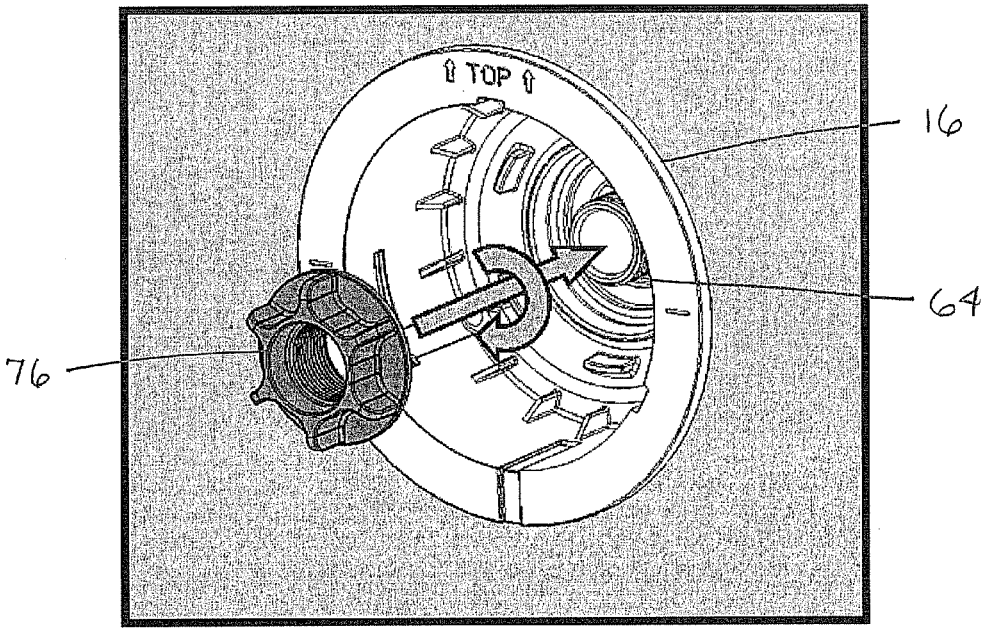
Figure 6D:
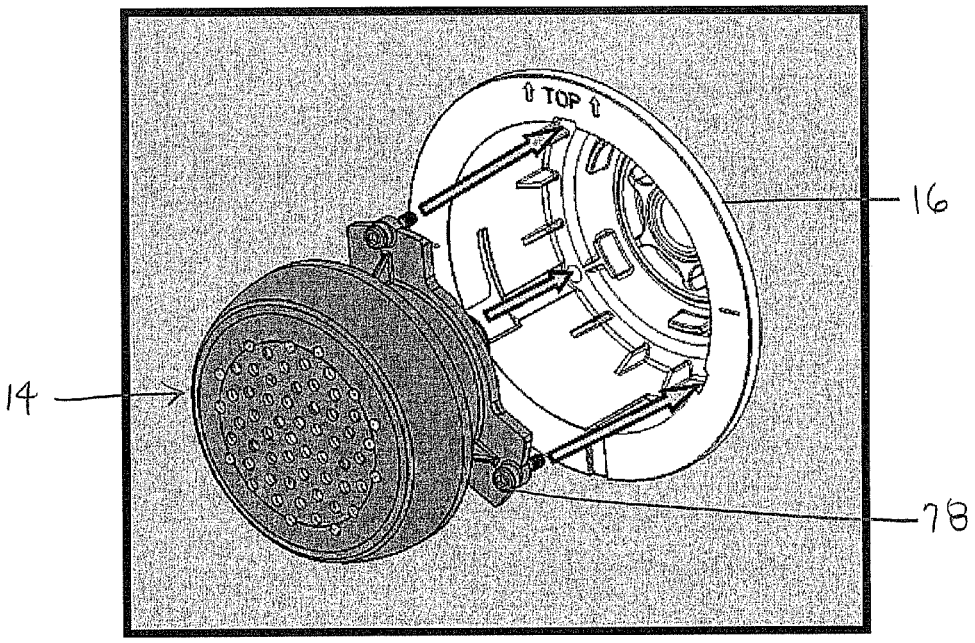
Figure 6E:
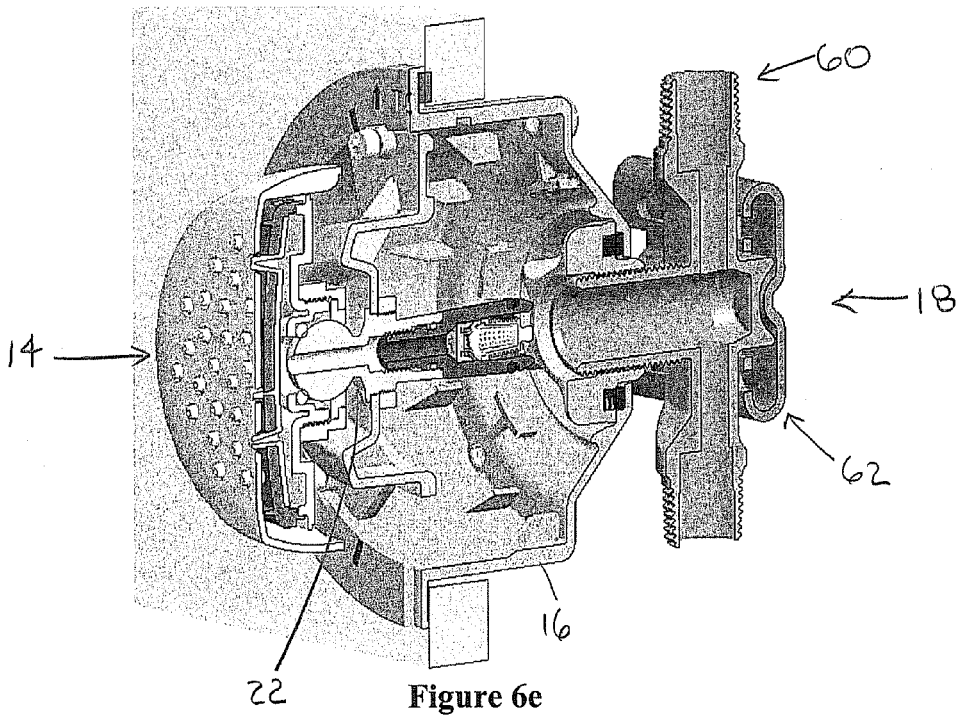
Figure 6F:
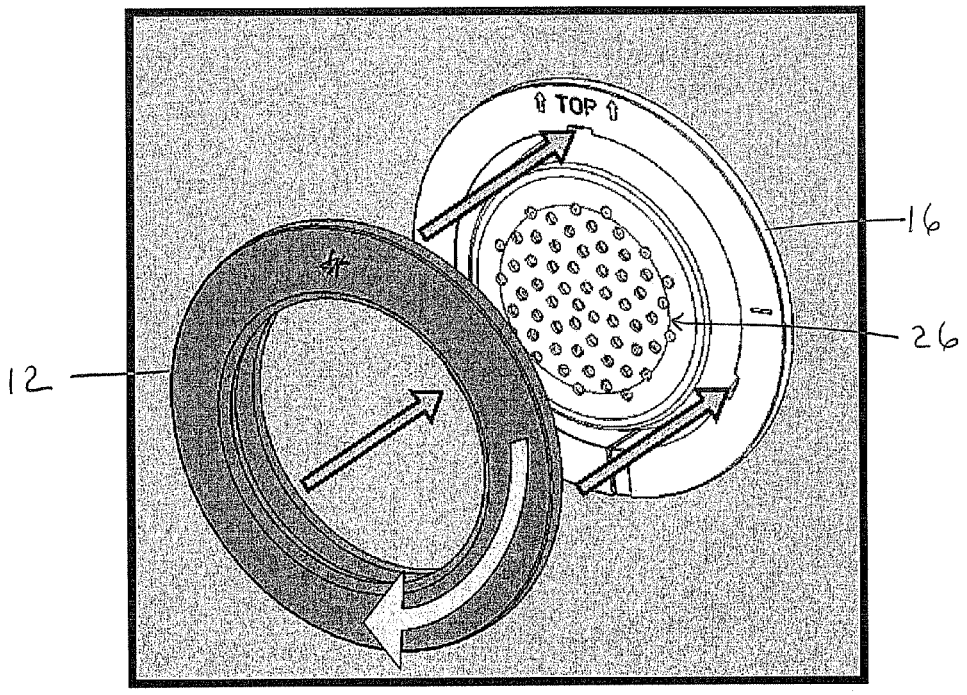

During installation, the housing 16 is inserted over the horizontal port 64 of the connector 60 (see FIG. 6*b*) and is attached to the mounting assembly 18 using a nut 76 or other conventional fastener (see FIG. 6*c*). The shaft 32/32*a* of the shower pivot assembly 22/22*a* is then inserted through the opening 74 in the housing 16 and into the horizontal port 64 of the connector 60 (see FIGS. 6*d* and 6*e*). The spray assembly 14 is then attached to the housing 16 using screws 78 or other conventional fasteners. The escutcheon 12 is then attached to the housing 16 surrounding the spray face 26 of the spray assembly 14 (see FIG. 6*f*).

When the body spray 10 is installed, water flows from the water supply into the connector 60, through the shaft 32/32*a* and the ball 30/30*a* of the shower pivot assembly 22/22*a*, through the spray engine 28, and out the spray face 26.

When the spray assembly 14 and/or the mounting assembly 18 are used in the body spray 10, all of the components do not need to be properly aligned in order for the escutcheon 12 to be mounted flush with the mounting surface and the spray face 26 to be centered in an opening 80 in the escutcheon 12. If misalignments are introduced during installation, the escutcheon 12 will still be mounted flush with the mounting surface and the spray face 26 will still be centered in the opening 80 in the escutcheon 12.

FIG. 3 illustrates how the body spray 10, including the spray assembly 14 and the mounting assembly 18, alone or in combination, ensure proper alignment of components of the body spray 10 and adequate sealing between the components.

As illustrated in FIG. 3, the bracket 62 is not properly aligned. As a result, the horizontal port 64 of the connector 60 is not horizontal (it is off horizontal by 2°). As a further result, an axis of the spray engine 28 will not be perpendicular to the mounting surface. Without the spray assembly 14, you will not be able to properly mount the body spray 10. However, with the spray assembly 14, and in particular, the shower pivot assembly 22/22*a*, the shaft 32/32*a* of the shower pivot assembly 22/22*a* can be angularly adjusted relative to the horizontal port 64 of the connector 60 so that the shower pivot assembly 22/22*a* is not coaxial with the horizontal port 64 of the connector 60. Therefore, the shaft 32/32*a* of the shower pivot assembly 22/22*a* can still be generally horizontal even though the horizontal port 64 of the connector 60 is not horizontal. Since the shaft 32/32*a* of the shower pivot assembly 22/22*a* is generally horizontal, the axis of the spray engine 28 (which is indirectly attached to the shower pivot assembly 22/22*a*) can be perpendicular to the mounting surface and the spray face 26 (which is also indirectly attached to the shower pivot assembly 22/22*a*) can be centered in the opening 80 in the escutcheon 12. Additionally, the shaft 32/32*a* of the shower pivot assembly 22/22*a* can be axially adjusted relative to the horizontal port 64 of the connector 60 so that the spray face 26 (which, again, is indirectly attached to the shower pivot assembly 22/22*a*) can be mounted flush with the escutcheon 12.

Further, as discussed above, the flange 68 on the connector 60 moves in the channel 70 on the bracket 62. As a result, the connector 60 can be moved along the bracket 62. Without the mounting assembly 18, once the bracket 62 is mounted to the mounting surface, the position of the connector 60 is fixed. Therefore, if the bracket 62 is not properly aligned, you will not be able to properly mount the body spray 10. However, with the mounting assembly 18, and in particular, the connector 60 and the bracket 62, even after the bracket 62 is mounted to the mounting surface, the position of the connector 60 is not fixed and the connector 60 can be moved along the bracket 62. Therefore, if the bracket 62 is not properly aligned, the connector 60 can be moved relative to the bracket 62 so that the spray face 26 (which is indirectly attached to the connector 60) can be centered in the opening 80 in the escutcheon 12.

One of ordinary skill in the art will now appreciate that the present invention provides an adjustable body spray including an adjustable spray assembly and an adjustable mounting assembly that, alone or in combination, ensure proper alignment of components of the body spray and adequate sealing between the components. Although the present invention has been shown and described with reference to a particular embodiment, equivalent alterations and modifications will occur to those skilled in the art upon reading and understanding this specification. The present invention includes all such equivalent alterations and modifications and is limited only by the scope of the following claims in light of their full scope of equivalents.

What is claimed is:

1. A body spray for mounting in an opening in a mounting surface, the body spray comprising:

a housing, the housing including a first opening in a front of the housing and a second opening in a rear of the housing, the housing being operable to mount in an opening in a mounting surface, the mounting surface being generally planar;

a mounting assembly, the mounting assembly including a connector, the connector being operable to connect to a water supply pipe behind the opening in the mounting surface, the connector including a port, the port being operable to be inserted through the second opening in the housing; and a spray assembly, the spray assembly including a spray head, a shower pivot assembly, and a body, the spray head being operable to be mounted in the first opening in the housing and to deliver water from the body spray, the shower pivot assembly including a pivot and a shaft, the pivot being operable to be attached to the spray head, at least a portion of the shaft being operable to be inserted into the port of the connector, both the pivot and the shaft being operable to angularly move relative to the port of the connector, the body being operable to be attached to both the housing and the shower pivot assembly;

wherein, during installation of the body spray, the angular movement of both the pivot and the shaft relative to the port of the connector enables the spray head to be adjusted relative to both the opening in the mounting surface and the first opening in the housing;

wherein, after installation of the body spray, both the mounting assembly and the shaft are located behind the mounting surface, at least a portion of the housing is located behind the mounting surface, and both the body and the pivot are enclosed within the portion of the housing that is located behind the mounting surface; and wherein the pivot includes a ball.

2. A body spray for mounting in an opening in a mounting surface, the body spray comprising:

a housing, the housing including a first opening in a front of the housing and a second opening in a rear of the housing, the housing being operable to mount in an opening in a mounting surface, the mounting surface being generally planar;

a mounting assembly, the mounting assembly including a connector, the connector being operable to connect to a water supply pipe behind the opening in the mounting surface, the connector including a port, the port being operable to be inserted through the second opening in the housing; and a spray assembly, the spray assembly including a spray head, a shower pivot assembly, and a body, the spray head being operable to be mounted in the first opening in the housing and to deliver water from the body spray, the shower pivot assembly including a pivot and a shaft, the pivot being operable to be attached to the spray head, at least a portion of the shaft being operable to be inserted into the port of the connector, both the pivot and the shaft being operable to angularly move relative to the port of the connector, the body being operable to be attached to both the housing and the shower pivot assembly;

wherein, during installation of the body spray, the angular movement of both the pivot and the shaft relative to the port of the connector enables the spray head to be adjusted relative to both the opening in the mounting surface and the first opening in the housing;

wherein, after installation of the body spray, both the mounting assembly and the shaft are located behind the mounting surface, at least a portion of the housing is located behind the mounting surface, and both the body and the pivot are enclosed within the portion of the housing that is located behind the mounting surface;

wherein the shaft includes a front end and a rear end; and wherein at least a portion of the shaft tapers outwardly between the front end and the rear end so that the shower pivot assembly can angularly move relative to the port of the connector.

3. The body spray of claim 2, wherein the portion of the shaft tapers outwardly up to five degrees.

4. A body spray for mounting in an opening in a mounting surface, the body spray comprising:

a housing, the housing including a first opening in a front of the housing and a second opening in a rear of the housing, the housing being operable to mount in an opening in a mounting surface, the mounting surface being generally planar;

a mounting assembly, the mounting assembly including a connector, the connector being operable to connect to a water supply pipe behind the opening in the mounting surface, the connector including a port, the port being operable to be inserted through the second opening in the housing; and a spray assembly, the spray assembly including a spray head, a shower pivot assembly, and a body, the spray head being operable to be mounted in the first opening in the housing and to deliver water from the body spray, the shower pivot assembly including a pivot and a shaft, the pivot being operable to be attached to the spray head, at least a portion of the shaft being operable to be inserted into the port of the connector, both the pivot and the shaft being operable to angularly move relative to the port of the connector, the body being operable to be attached to both the housing and the shower pivot assembly;

wherein, during installation of the body spray, the angular movement of both the pivot and the shaft relative to the port of the connector enables the spray head to be adjusted relative to both the opening in the mounting surface and the first opening in the housing;

wherein, after installation of the body spray, both the mounting assembly and the shaft are located behind the mounting surface, at least a portion of the housing is located behind the mounting surface, and both the body and the pivot are enclosed within the portion of the housing that is located behind the mounting surface;

wherein the shaft includes a forward shaft portion and a rearward shaft portion;

wherein the forward shaft portion includes a socket;

wherein the rearward shaft portion includes a ball; and wherein the socket of the forward shaft portion receives the ball of the rearward shaft portion so that the shower pivot assembly can angularly move relative to the port of the connector.

5. The body spray of claim 4, wherein the socket includes an opening;

wherein the opening includes a front end and a rear end; and wherein the opening tapers outwardly between the front end and the rear end.

6. A body spray for mounting in an opening in a mounting surface, the body spray comprising:

a housing, the housing including a first opening in a front of the housing and a second opening in a rear of the housing, the housing being operable to mount in an opening in a mounting surface, the mounting surface being generally planar;

a mounting assembly, the mounting assembly including a connector, the connector being operable to connect to a water supply pipe behind the opening in the mounting surface, the connector including a port, the port being operable to be inserted through the second opening in the housing; and a spray assembly, the spray assembly including a spray head, a shower pivot assembly, and a body, the spray head being operable to be mounted in the first opening in the housing and to deliver water from the body spray, the shower pivot assembly including a pivot and a shaft, the pivot being operable to be attached to the spray head, at least a portion of the shaft being operable to be inserted into the port of the connector, both the pivot and the shaft being operable to angularly move relative to the port of the connector, the body being operable to be attached to both the housing and the shower pivot assembly;

wherein, during installation of the body spray, the angular movement of both the pivot and the shaft relative to the port of the connector enables the spray head to be adjusted relative to both the opening in the mounting surface and the first opening in the housing;

wherein, after installation of the body spray, both the mounting assembly and the shaft are located behind the mounting surface, at least a portion of the housing is located behind the mounting surface, and both the body and the pivot are enclosed within the portion of the housing that is located behind the mounting surface;

wherein the connector includes a flange;

wherein the mounting assembly includes a bracket and the bracket includes a channel;

wherein the flange on the connector is operable to move in the channel on the bracket; and wherein movement of the flange in the channel enables the shower pivot assembly to be moved so that the spray head can be adjusted relative to the opening in the mounting surface.

7. A body spray for mounting in an opening in a mounting surface, the body spray comprising:

a housing, the housing including a first opening in a front of the housing and a second opening in a rear of the housing, the housing being operable to mount in an opening in a mounting surface, the mounting surface being generally planar;

a mounting assembly, the mounting assembly including a connector, the connector being operable to connect to a water supply pipe behind the opening in the mounting surface, the connector including a port, the port being operable to be inserted through the second opening in the housing; and a spray assembly, the spray assembly including a spray head, a shower pivot assembly, and a body, the spray head being operable to be mounted in the first opening in the housing and to deliver water from the body spray, the shower pivot assembly including a pivot and a shaft, the pivot being operable to be attached to the spray head, at least a portion of the shaft being operable to be inserted into the port of the connector, both the pivot and the shaft being operable to angularly move relative to the port of the connector, the body being operable to be attached to both the housing and the shower pivot assembly;

wherein, during installation of the body spray, the angular movement of both the pivot and the shaft relative to the port of the connector enables the spray head to be adjusted relative to both the opening in the mounting surface and the first opening in the housing;

wherein, after installation of the body spray, both the mounting assembly and the shaft are located behind the mounting surface, at least a portion of the housing is located behind the mounting surface, and both the body and the pivot are enclosed within the portion of the housing that is located behind the mounting surface; and wherein, after installation of the body spray, the pivot and the shaft are fixed relative to each other.

8. The body spray of claim 7, wherein the shower pivot assembly is operable to axially move relative to the port of the connector; and wherein the axial movement of the shower pivot assembly relative to the port of the connector enables the spray head to be adjusted relative to the opening in the mounting surface.

9. The body spray of claim 7, wherein the pivot includes a ball.

10. The body spray of claim 7, wherein the shaft includes a front end and a rear end; and wherein at least a portion of the shaft tapers outwardly between the front end and the rear end so that the shower pivot assembly can angularly move relative to the port of the connector.

11. The body spray of claim 10, wherein the portion of the shaft tapers outwardly up to five degrees.

12. The body spray of claim 7, wherein the shaft includes a forward shaft portion and a rearward shaft portion;

wherein the forward shaft portion includes a socket;

wherein the rearward shaft portion includes a ball; and wherein the socket of the forward shaft portion receives the ball of the rearward shaft portion so that the shower pivot assembly can angularly move relative to the port of the connector.

13. The body spray of claim 12, wherein the socket includes an opening;

wherein the opening includes a front end and a rear end; and wherein the opening tapers outwardly between the front end and the rear end.

14. A body spray for mounting in an opening in a mounting surface, the body spray comprising:

a housing, the housing including a first opening in a front of the housing and a second opening in a rear of the housing, the housing being operable to mount in an opening in a mounting surface, the mounting surface being generally planar;

a mounting assembly, the mounting assembly including a connector, the connector being operable to connect to a water supply pipe behind the opening in the mounting surface, the connector including a port, the port being operable to be inserted through the second opening in the housing; and a spray assembly, the spray assembly including a spray head, a shower pivot assembly, and a body, the spray head being operable to be mounted in the first opening in the housing and to deliver water from the body spray, the shower pivot assembly including a pivot and a shaft, the pivot being operable to be attached to the spray head, at least a portion of the shaft being operable to be inserted into the port of the connector, both the pivot and the shaft being operable to angularly move relative to the port of the connector, the body being operable to be attached to both the housing and the shower pivot assembly;

wherein, during installation of the body spray, the angular movement of both the pivot and the shaft relative to the port of the connector enables the spray head to be adjusted relative to both the opening in the mounting surface and the first opening in the housing;

wherein, after installation of the body spray, both the mounting assembly and the shaft are located behind the mounting surface, at least a portion of the housing is located behind the mounting surface, and both the body and the pivot are enclosed within the portion of the housing that is located behind the mounting surface; and wherein, after installation of the body spray, both the pivot and the shaft are fixed relative to the port of the connector.

15. The body spray of claim 14, wherein the shower pivot assembly is operable to axially move relative to the port of the connector; and wherein the axial movement of the shower pivot assembly relative to the port of the connector enables the spray head to be adjusted relative to the opening in the mounting surface.

16. The body spray of claim 14, wherein the shaft includes a front end and a rear end; and wherein at least a portion of the shaft tapers outwardly between the front end and the rear end so that the shower pivot assembly can angularly move relative to the port of the connector.

17. The body spray of claim 14, wherein the shaft includes a forward shaft portion and a rearward shaft portion;

wherein the forward shaft portion includes a socket;

wherein the rearward shaft portion includes a ball; and wherein the socket of the forward shaft portion receives the ball of the rearward shaft portion so that the shower pivot assembly can angularly move relative to the port of the connector.

* * * * *